US011348494B2

(12) United States Patent
Ritondo

(10) Patent No.: US 11,348,494 B2
(45) Date of Patent: May 31, 2022

(54) MOUNTING DEVICE

(71) Applicant: Duane Ritondo, Frederick, MD (US)

(72) Inventor: Duane Ritondo, Frederick, MD (US)

( * ) Notice: Subject to any disclaimer, the term of this patent is extended or adjusted under 35 U.S.C. 154(b) by 58 days.

(21) Appl. No.: 17/015,257

(22) Filed: Sep. 9, 2020

(65) Prior Publication Data

US 2021/0327315 A1 Oct. 21, 2021

Related U.S. Application Data

(60) Provisional application No. 63/011,327, filed on Apr. 17, 2020.

(51) Int. Cl.
*G09F 17/00* (2006.01)
*E04H 13/00* (2006.01)

(52) U.S. Cl.
CPC ..... *G09F 17/00* (2013.01); *E04H 13/003* (2013.01)

(58) Field of Classification Search
CPC ..... G09F 17/00; G09F 2017/0066; E04H 13/003; A01K 97/10; A47G 33/12
See application file for complete search history.

(56) References Cited

U.S. PATENT DOCUMENTS 1,551,719 A * 9/1925 Williams ..... E04H 12/32 248/512
3,164,343 A * 1/1965 Cucullo ..... A47G 7/044 248/27.8
3,547,569 A * 12/1970 Fenton ..... F21V 35/00 431/295
D241,006 S * 8/1976 Wallace ..... D8/373
5,377,944 A * 1/1995 Getsinger ..... G09F 17/00 248/218.4
7,793,462 B1 * 9/2010 Sherette ..... G09F 17/00 47/41.1
8,544,407 B2 * 10/2013 Spray ..... E01F 9/688 116/63 C
D717,132 S * 11/2014 Van Dyke ..... G09F 17/00 D7/708
9,378,666 B1 * 6/2016 Woodruff ..... G09F 17/00
11,208,773 B2 * 12/2021 Mueller ..... E01F 9/617
2009/0158654 A1 * 6/2009 Crane ..... G09F 17/00 47/66.6
2010/0209662 A1 * 8/2010 Slade ..... A47G 23/02 428/131
2011/0010988 A1 * 1/2011 Lanoha ..... A47G 7/06 47/41.1
2012/0186511 A1 * 7/2012 Spray ..... E01F 9/654 116/63 C

* cited by examiner

*Primary Examiner* — Anita M King
(74) *Attorney, Agent, or Firm* — Brennan, Manna & Diamond, LLC

(57) ABSTRACT

A flag mounting device for engaging a gravesite vase. The flag mount device is generally diamond shaped with a central opening for engaging a top of the vase. When positioned atop the vase the flag mounting device is horizontally disposed with respect to the ground. A container securing component penetrates the flag mounting device horizontally extending from a corner inward into the central opening and engages the top of the vase to secure the flag mounting device to the vase. A pair of flagpole bores partially penetrate a top of the flag mounting device and are configures to receive a pair or miniature flagpoles. Each miniature flagpole is secured within the respective flagpole bore by a flagpole securing component that extends from a side corner inward into the flagpole bore.

11 Claims, 2 Drawing Sheets

MOUNTING DEVICE

CROSS-REFERENCE TO RELATED APPLICATION

The present application claims priority to, and the benefit of, U.S. Provisional Application No. 63/011,327, which was filed on Apr. 17, 2020 and is incorporated herein by reference in its entirety.

BACKGROUND

The present invention generally relates to memorialization device, and more specifically to a mounting device for displaying a flag or pennant at a gravesite. Accordingly, the present specification makes specific reference thereto. However, it is to be appreciated that aspects of the present invention are also equally amenable to other like applications, devices and methods of manufacture.

The loss of a loved one or friend is a significant life event that is emotionally taxing and extremely overwhelming. Having somewhere to go and remember the deceased person is important to family and friends. There are many ways to memorialize or show tribute to the deceased where they are interned. Some people plant trees or bring plants or flowers to the gravesite. Others leave icons, statues, or pictures at the cemetery. Creating memorials or tributes to lost loved ones is a large part of coping with bereavement and going through the grieving process at a painful time in life. Sometimes these memorials are attached to tombstones or are positioned around the grave.

Vases, urns, or other decorative items are commonly placed at gravesites to memorialize the deceased. Flags, such national flags, ethnic flags, pennants, and the like are placed in the ground, staked in a vase, or attached to a gravestone bracket. However, these flags can easily become dislodged or otherwise displaced over time falling to the ground. Cemetery grounds are often littered with accidently dislodged plastic flowers, pictures, flags, etc., and create additional work for the groundskeepers.

Military families and veterans often choose to memorialize their loved ones with flags. The American flag, a state flag, or even a military branch or unit flag are commonly chosen to represent the deceased's prior involvement and achievements. These flags tend to be relatively small in scale out of respect to the space limitations in cemeteries. As mentioned above, these flags are often poorly secured or simply staked into the ground leaving them at risk. United States flag etiquette dictates that U.S. flags of any size must be in good condition and should never tough the ground. Unfortunately, wind, animals, and even other cemetery visitors may accidently dislodge these graveside flags leading to an unintended breach of U.S. flag etiquette.

Accordingly, there is a great need for a way to provide users with a way to provide a tribute to a deceased family member or friend. The present invention allows users to express their respects for a deceased loved one by safely and securely displaying a flag. A primary feature of the present invention is a flag mounting device that will securely retain the flag at the place of internment. The improved flag mounting device of the present invention is capable of maintaining flags in an upright position off of the ground.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises a flag mounting device. The flag mounting device is configured to engage a container, such as a graveside vase so that the flag mount device is oriented generally horizontally with respect to the ground when in position atop the container. The flag mounting device is further configured to retain and secure at least one miniature flag so that the miniature flag is elevated off of the ground.

The flag mounting device comprises a body and a central opening. The body is generally diamond shaped comprising a front corner, a back corner, and a pair of side corners. The central opening is centrally disposed within the diamond shaped body vertically penetrating the body from top to bottom. The central opening may be circular, oval, or square shaped to accommodate the container. The flag mounting device further comprises a container securing component. The container securing component comprises at least one threaded hole and a screw adjustable within the threaded hole. The threaded hole penetrates the diamond shaped body and extends horizontally from a back or a front corner into the central opening. The container securing component may further comprises a second threaded hole and a second screw adjustable within the second threaded hole. The second threaded hole penetrates the diamond shaped body and extends horizontally from the opposite corner than the at least one threaded hole into the central opening. To secure the container retained in the central opening, each screw is threaded into the central opening until it engages the container.

The flag mounting device further comprises a pair of flagpole bores and a pair of flagpole securing components. The flagpole bores partially penetrate the diamond shaped body distal to and on opposing sides of the central opening. The flagpole bores may be angled or vertically disposed and are sized to accept and retain a flagpole from a miniature flag. Each of the flagpole securing components comprise a threaded hole and a screw. Each threaded hole penetrates the diamond shaped body horizontally from the corresponding side corner and extends into the corresponding flagpole bore. To secure the flagpole retained in the flagpole bore, the screw is threaded into the flagpole bore until it engages the flagpole.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
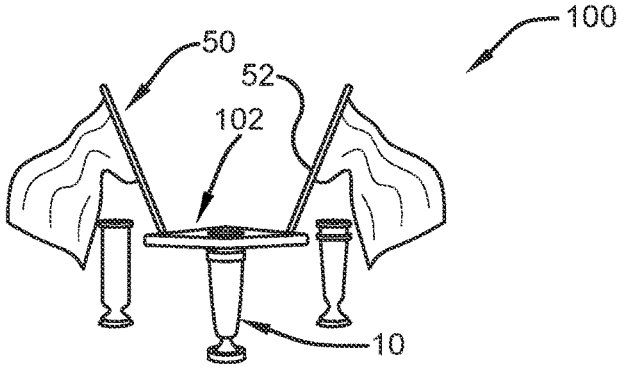
FIG. 1 illustrates a perspective view of one embodiment of a flag mounting device of the present invention engaging a container and retaining a pair of flags in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They do not intend as an exhaustive description of the invention or do not limit the scope of the invention. Additionally, an illustrated embodiment need not have all the aspects or advantages shown. Thus, in other embodiments, any of the features described herein from different embodiments may be combined.

The present invention, in one exemplary embodiment, is a flag mounting device for gravestone vases designed to maintain flags in an upright or angled position on cemetery grounds. The flag mounting device features a diamond shaped configuration with flag mounts on opposite ends of the device. The flag mounting device utilizes a circular central opening to accommodate a top of the vase securable via a pair of screws on opposing sides. The invention maximizes support for miniature flags installed on cemetery grounds, preventing the flags from accidently touching the ground and creating additional work for maintenance workers. The flag mounting device offers a way to respect the American flag and those who sacrificed their lives in its service.

The flag mounting device is essentially a gravestone flag mount for vases and other devices in one embodiment. The flag mounting device features a diamond-shaped body with holes on opposing points of the diamond body. Notwithstanding, it is also contemplated that other shapes could also be used such as, without limitation, oval, circular, square, rectangular, etc. The central opening accepts the top of the vase suspending the flag mounting device off of the ground. Users can install miniature flags within the holes on the opposite ends of the body. The flags are secured within the holes via integrated screws, thereby maximizing security and preventing dislodgement of the flags. The flag mounting device may be constructed using stainless steel, bronze, plastic, or other suitable weather-resistant materials.

Figure 5:
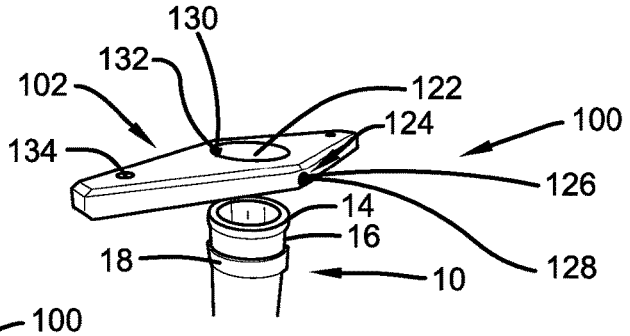
FIG. 5 illustrates a perspective view of the flag mount device of the present invention preparing to engage the container in accordance with the disclosed architecture.

Referring initially to the drawings, FIG. 1 illustrates a flag mounting device 100. The flag mounting device 100 is configured to engage and mount on a container 10, such as a graveside or cemetery vase so that the flag mounting device 100 is oriented generally horizontally with respect to the ground when in position atop the container 10. The flag mounting device 100 is further configured to retain at least one miniature flag 50 so that the miniature flag 50 is elevated off of the ground. As illustrated in FIG. 5, the flag mounting device 100 will fit over a lip 14 of the container 10 typically engaging a neck 16 of the container 10 above a shoulder 18.

Figure 2A:
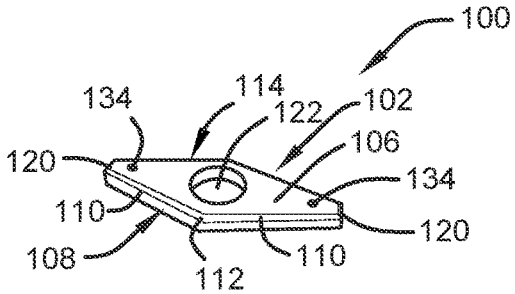
FIG. 2A illustrates a perspective view of the flag mount device of the present invention comprising a circular central opening in accordance with the disclosed architecture.
Figure 2B:
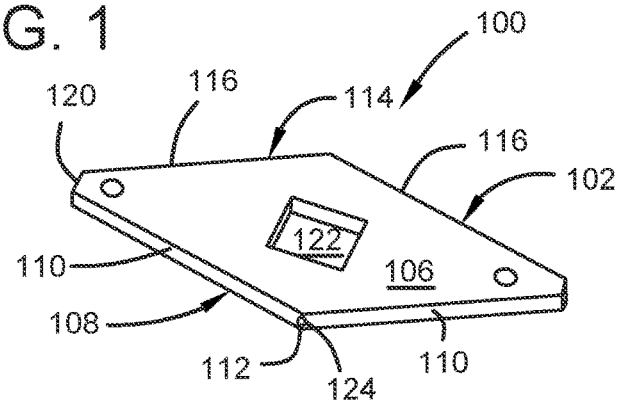
FIG. 2B illustrates a perspective view of the flag mount device of the present invention comprising a square central opening in accordance with the disclosed architecture.
Figure 2C:
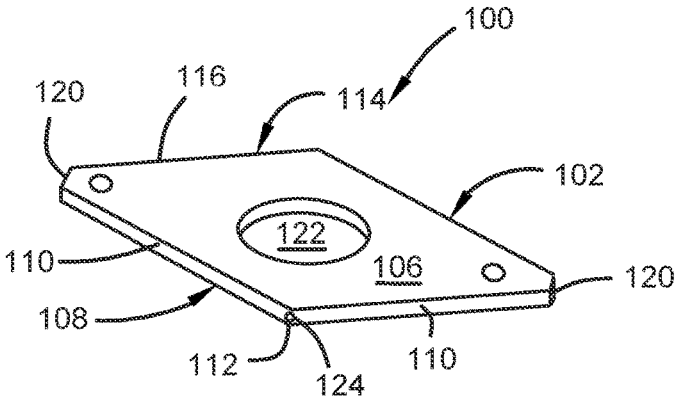
FIG. 2C illustrates a perspective view of the flag mount device of the present invention comprising an oval central opening in accordance with the disclosed architecture.

As illustrated in FIG. 2A, the flag mounting device 100 comprises a body 102 and a central opening 122. The body 102 is generally diamond shaped and flat in configuration. The diamond shaped body 102 comprises a top 106, a bottom 104, a front 108, and a back 114. The front 108 comprises a pair of front segments 110 intersecting at a front corner 112. The back 114 comprises a pair of back segments 116 intersecting at a back corner 118. The diamond shaped body 102 further comprises a pair of side corners 120 where one of the front segments 110 intersects one of the back segments 116. The diamond shaped body 102 is typically elongated and is wider from side corner 120 to side corner 120 than from front corner 112 to back corner 118.

The central opening 122 is centrally disposed within the diamond shaped body 102 vertically penetrating the body 102 from the top 106 to the bottom 104. As illustrated in FIGS. 2A-3A, the central opening 122 may be circular, oval, or square in shape to engage and accommodate the container 10 as discussed supra. Additionally, the central opening 122 may be beveled as illustrated in FIG. 3B to better engage the container 10. The diameter of the central opening 122 is typically at least approximately three inches but may be larger or smaller as desired.

As illustrated in FIGS. 2A, 3A, 3B, and 5, the flag mounting device 100 further comprises a container securing component 124. The container securing component 124 is used to secure the container 10 within the central opening 122. The container securing component 124 comprises at least one threaded hole 126 and a screw 128, such as a set screw that is adjustable within the at least one threaded hole 126. The at least one threaded hole 126 penetrates the diamond shaped body 102 and extends substantially horizontally from the back corner 118 or the front corner 112 into the central opening 122.

The container securing component 124 may further comprises a second threaded hole 130 and a second screw 132 adjustable within the second threaded hole 130. The second threaded hole 130 penetrates the diamond shaped body 102 and extends into the central opening 122 horizontally from the opposite corner 112 or 118 than the at least one threaded hole 126. If the at least one threaded hole 126 penetrates inward from the back corner 118, the second threaded hole 130 could penetrate inward from the front corner 112. To secure the container 10 retained in the central opening 122, each screw 128 or 132 is threaded through the respective threaded hole 126 and 130 into the central opening 122 until it engages the container 10. Each screw 128 or 132 will push the neck 16 of the container 10 against the central opening 122 or into the opposing screw 128 of 132.

As illustrated in FIGS. 2A-6, the flag mounting device 100 further comprises at least one flagpole bore 134. The at least one flagpole bore 134 partially penetrates the diamond shaped body 102 distal to the central opening 122. The at least one flagpole bore 134 is typically a pair of flagpole bores. The pair flagpole bores 134 each partially penetrate the diamond shaped body 102 distal to and on opposing sides of the central opening 122. As such, each of the pair of flagpoles bores 134 is located between the central opening 122 and one of the respective pair of side corners 120.

Figure 3A:
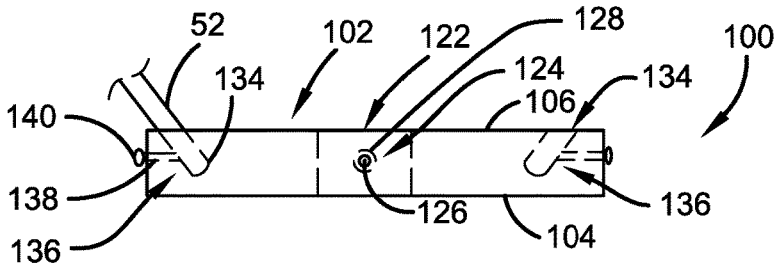
FIG. 3A illustrates a side view of the flag mount device of the present invention in accordance with the disclosed architecture.
Figure 3B:
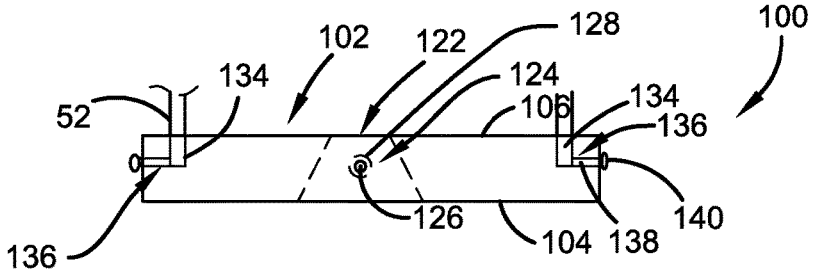
FIG. 3B illustrates a side view of the flag mount device of the present invention where the central opening is beveled in accordance with the disclosed architecture.
Figure 4:
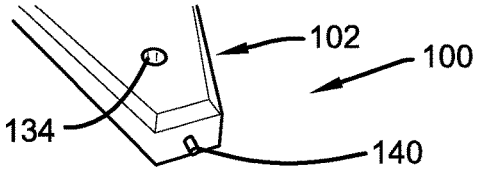
FIG. 4 illustrates a perspective closeup view of one side corner and one of a pair of flagpole bores of the flag mount device of the present invention in accordance with the disclosed architecture.
Figure 6:
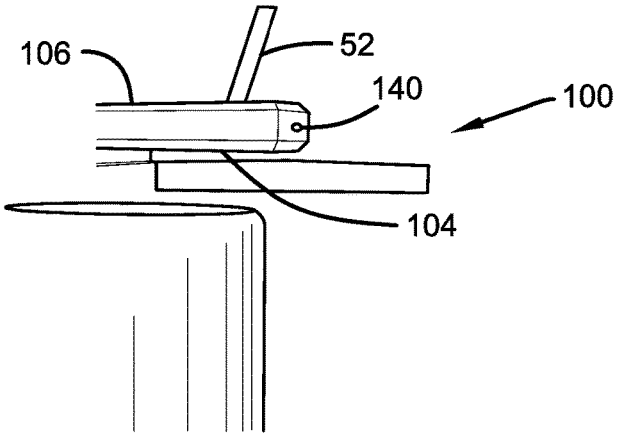
FIG. 6 illustrates a perspective closeup view of one of the flagpole bores of the flag mount device of the present invention engaging a flagpole of one of the flags in accordance with the disclosed architecture.

The pair of flagpole bores 134 may be angled, as illustrated in FIG. 3A, or vertically oriented, as illustrated in FIG. 3B, and are sized to accept and retain a flagpole 52 or dowel from a miniature flag 50 or pennant. In one example, each flagpole bore 132 may be approximately 2 1/64 to 3/8 inches in diameter. In another example, as illustrated in FIGS. 3A and 6, the pair of flagpole bores 134 are angled away from each other pointing away from the central opening 122. Alternatively, the pair of flagpole bores 134 may be angled toward the front 108 or back 114 of the diamond shaped body 102.

The flag mounting device 100 further comprises a pair of flagpole securing elements 136. Each of the flagpole securing components 136 are configured to secure one of the flagpoles 52 within the respective flagpole bore 134. Each of the flagpole securing components 136 comprise a pole securing threaded hole 138 and a pole securing screw 140, such as a set screw similar to screws 128 and 132. Each pole securing threaded hole 138 penetrates the diamond shaped body 102 generally horizontally from one of the pair of side corners 120 penetrating and extending into the corresponding flagpole bore 134. To secure the flagpole 52 retained in the flagpole bore 134, each pole securing screw 140 is threaded into the respective flagpole bore 134 until it engages the flagpole 52 and pushes the flagpole 52 against a side of the respective flagpole bore 134.

It is contemplated that the flag mounting device 100 constructed in accordance with the present invention will be tailored and adjusted by those of ordinary skill in the art to accommodate various levels of performance demand imparted during actual use. Accordingly, while this invention has been described by reference to certain specific embodiments and examples, it will be understood that this invention is capable of further modifications. This application is, therefore, intended to cover any variations, uses or adaptations of the invention following the general principles thereof, and including such departures from the present disclosure as come within known or customary practice in the art to which this invention pertains and fall within the limits of the appended claims.

Notwithstanding the forgoing, the flag mounting device 100 of the present invention and its various structural components can be of any suitable size, shape, and configuration as is known in the art without affecting the overall concept of the invention, provided that it accomplishes the above stated objectives. One of ordinary skill in the art will appreciate that the shape and size of the flag mounting device 100 and its various components and material, as shown in the FIGS. are for illustrative purposes only, and that many other shapes and sizes of the flag mounting device 100 are well within the scope of the present disclosure. Although the dimensions of the flag mounting device 100 are important design parameters, the and its components may be of any shape or size that ensures optimal performance during use and/or that suits user need and/or preference.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A flag mount device mountable on a container comprising:

a diamond shaped body;

a central opening disposed within the diamond shaped body for engaging the container;

a container securing component for securing the container within the central opening; and a pair of flagpole bores partially penetrating the diamond shaped body each configured to retain a flagpole, wherein the container securing component comprises a first threaded hole and first screw and a second threaded hole and a second screw and further wherein the first threaded hole penetrates the diamond shape body horizontally extending into the central opening from a back corner of the body and the second threaded hole penetrates the diamond shape body horizontally extending into the central opening from a front corner of the body.

2. The flag mounting device of claim 1, wherein the container securing component comprises a threaded hole and a screw.

3. The flag mounting device of claim 2, wherein the threaded hole penetrates the diamond shape body horizontally extending into the central opening.

4. The flag mounting device of claim 1, wherein the pair of flagpole bores are angled away from each other.

5. The flag mounting device of claim 1, wherein the pair of flagpole bores are vertical.

6. A flag mount device mountable on a container comprising:

a diamond shaped body;

a central opening disposed within the diamond shaped body for engaging the container;

a container securing component for securing the container within the central opening;

a pair of flagpole bores partially penetrating the diamond shaped body each configured to retain a flagpole; and a pair of flagpole securing components for securing each flagpole within the respective flagpole bore.

7. The flag mounting device of claim 6, wherein each of the flagpole securing components comprise a threaded hole and a screw.

8. The flag mounting device of claim 7, wherein each threaded hole penetrates the diamond shape body horizontally extending into the respective flagpole bore.

9. The flag mounting device of claim 7, wherein each threaded hole penetrates the diamond shape body from one of a pair of side corners of the diamond shaped body.

10. The flag mounting device of claim 6, wherein the container securing component comprises a threaded hole and a screw.

11. The flag mounting device of claim 10, wherein the threaded hole penetrates the diamond shape body horizontally extending into the central opening.

* * * * *